US008810426B1

(12) United States Patent
Morris

(10) Patent No.: US 8,810,426 B1
(45) Date of Patent: Aug. 19, 2014

(54) LIFE SAFETY DEVICE WITH COMPACT CIRCUMFERENTIAL ACOUSTIC RESONATOR

(71) Applicant: Gary Jay Morris, Morgantown, WV (US)

(72) Inventor: Gary Jay Morris, Morgantown, WV (US)

( * ) Notice: Subject to any disclaimer, the term of this patent is extended or adjusted under 35 U.S.C. 154(b) by 0 days.

(21) Appl. No.: 14/262,782

(22) Filed: Apr. 27, 2014

Related U.S. Application Data

(60) Provisional application No. 61/816,801, filed on Apr. 28, 2013.

(51) Int. Cl.
*G08B 25/08* (2006.01)
*G08B 3/10* (2006.01)

(52) U.S. Cl.
CPC ..... *G08B 3/10* (2013.01)
USPC ..... 340/692; 340/541; 340/500; 340/691.1; 340/628; 116/137 R

(58) Field of Classification Search
USPC ..... 340/692, 628, 541; 116/137 R
See application file for complete search history.

(56) References Cited

U.S. PATENT DOCUMENTS

| | | | | |
|---|---|---|---|---|
| 1,836,222 | A | | 12/1931 | Bonine |
| 2,746,558 | A | | 5/1956 | Levy |
| 3,687,221 | A | | 8/1972 | Bonnard |
| 3,917,024 | A | | 11/1975 | Kaiser |
| 3,923,124 | A | | 12/1975 | Hancock |
| 4,282,520 | A | | 8/1981 | Shipp et al. |
| 4,297,538 | A | | 10/1981 | Massa |
| 4,399,427 | A | * | 8/1983 | Neese ..... 340/388.1 |
| 4,417,235 | A | | 11/1983 | Del Grande |
| 4,517,915 | A | * | 5/1985 | Olsson et al. ..... 116/137 R |
| 4,686,407 | A | * | 8/1987 | Ceperley ..... 310/323.01 |
| 4,700,177 | A | * | 10/1987 | Nakashima et al. ..... 340/388.3 |
| 4,982,436 | A | | 1/1991 | Cowan |
| 5,274,709 | A | | 12/1993 | Koizumi |
| 5,317,876 | A | * | 6/1994 | Nakagawa et al. ..... 60/532 |
| 5,321,388 | A | | 6/1994 | Biersach |
| 5,475,368 | A | * | 12/1995 | Collins ..... 340/574 |
| 5,594,422 | A | | 1/1997 | Huey et al. |
| 5,664,020 | A | | 9/1997 | Goldfarb et al. |
| 5,675,312 | A | | 10/1997 | Burnett |

(Continued)

FOREIGN PATENT DOCUMENTS

| | | | |
|---|---|---|---|
| CN | 1707608 | A | 12/2005 |
| EP | 1881470 | A1 | 1/2008 |
| JP | 2005141079 | | 6/2005 |
| WO | WO2009060420 | | 5/2009 |

*Primary Examiner* — George Bugg
*Assistant Examiner* — Naomi Small
(74) *Attorney, Agent, or Firm* — Gary J. Morris

(57) ABSTRACT

Low frequency alarm tones emitted by life safety devices are more likely to notify sleeping children and the elderly. Disclosed herein is a life safety device equipped with a novel, compact, circumferential resonant cavity which increases the low frequency (400-600 Hz square wave) acoustic efficiency of an audio output apparatus formed by acoustically coupling an audio output transducer to the resonant cavity. The resonant cavity is a compact circumferential acoustic resonator with a captured mass of air within a ring shaped cavity significantly reducing the overall size of the resonator, thereby permitting the audio output apparatus to fit within the housing of conventional size life safety devices such as, but not limited to, residential and commercial smoke alarms and carbon monoxide alarms. The compact resonator is an acoustic compliant cavity with internal passages transforming axial traveling sound waves to circumferentially traveling sound waves thereby yielding a very compact geometry.

29 Claims, 9 Drawing Sheets

(56) References Cited

U.S. PATENT DOCUMENTS

| | | | | |
|---|---|---|---|---|
| 5,710,395 | A | 1/1998 | Wilke | |
| 5,751,827 | A | 5/1998 | Takahshi | |
| 5,889,875 | A | 3/1999 | Caron et al. | |
| 5,953,436 | A | 9/1999 | Zimmermann | |
| 5,990,797 | A | 11/1999 | Zlotchenko et al. | |
| 6,035,051 | A | 3/2000 | Sato | |
| 6,356,643 | B2 | 3/2002 | Yamagishi et al. | |
| 6,425,456 | B1 | 7/2002 | George | |
| 6,573,833 | B1 * | 6/2003 | Rosenthal | 340/539.13 |
| 6,634,455 | B1 | 10/2003 | Yang | |
| 6,646,548 | B2 | 11/2003 | Dornfeld | |
| 6,648,098 | B2 | 11/2003 | Nichols | |
| 6,973,994 | B2 | 12/2005 | Mackin | |
| 7,051,835 | B2 | 5/2006 | Martikainen | |
| 7,068,176 | B2 | 6/2006 | Black et al. | |
| 7,284,638 | B1 | 10/2007 | Sahyoun | |
| 7,528,701 | B2 | 5/2009 | Adelman | |
| 7,605,687 | B2 | 10/2009 | Morris | |
| 7,702,114 | B2 | 4/2010 | Aarts | |
| 7,714,700 | B2 | 5/2010 | Morris | |
| 7,956,764 | B2 | 6/2011 | Morris | |
| 8,237,577 | B2 | 8/2012 | Albert et al. | |
| 8,242,899 | B2 | 8/2012 | Albert et al. | |
| 8,525,689 | B2 | 9/2013 | Smith et al. | |
| 8,558,708 | B2 | 10/2013 | Albert et al. | |
| 2003/0085813 | A1 * | 5/2003 | Burnett et al. | 340/692 |
| 2004/0003961 | A1 | 1/2004 | Gunness | |
| 2005/0128058 | A1 | 6/2005 | Oyagi | |
| 2006/0029241 | A1 | 2/2006 | Graber | |
| 2006/0045301 | A1 | 3/2006 | Jakubaitis | |
| 2007/0084396 | A1 * | 4/2007 | Cleckler et al. | 116/137 R |
| 2008/0024314 | A1 * | 1/2008 | Hill et al. | 340/644 |
| 2008/0197998 | A1 | 8/2008 | Campmans | |
| 2008/0272895 | A1 * | 11/2008 | Young et al. | 340/388.4 |
| 2008/0314680 | A1 * | 12/2008 | Doneux et al. | 181/290 |
| 2009/0184830 | A1 * | 7/2009 | Watabe et al. | 340/628 |
| 2011/0056763 | A1 * | 3/2011 | Tanase et al. | 181/295 |
| 2011/0095896 | A1 | 4/2011 | Lewis et al. | |
| 2011/0095900 | A1 | 4/2011 | Smith et al. | |
| 2011/0193697 | A1 | 8/2011 | Albert | |
| 2013/0076511 | A1 * | 3/2013 | Blanc et al. | 340/540 |
| 2013/0146390 | A1 | 6/2013 | Runciman | |
| 2014/0016813 | A1 | 1/2014 | Morris | |

* cited by examiner

LIFE SAFETY DEVICE WITH COMPACT CIRCUMFERENTIAL ACOUSTIC RESONATOR

CROSS REFERENCES TO RELATED PATENT APPLICATIONS

This patent application claims the benefit of provisional patent application No. 61/816,801 filed on Apr. 28, 2013 which is incorporated by reference herein in its entirety.

FIELD OF INVENTION

This invention relates to life safety devices that emit low frequency alarm tones on the order, but not limited to, 520 Hz fundamental frequency when a sensor in the device senses an environmental condition such as, but limited to, smoke, fire, gas, carbon monoxide, intrusion, glass breakage, vibration, moisture, heat, motion, etc. A compact acoustic resonant cavity (resonator) is used comprising a circumferential passage so that the dimensions of the cavity can fit within a compact housing for the life safety device and so that the power is small to drive an audio output transducer acoustically coupled to the compact resonator.

BACKGROUND OF THE INVENTION

Research has shown that compared to high frequency alarm tones (on the order of 3 kHz), low frequency alarm tones on the order of a 520 Hz fundamental frequency, square wave can be more effective in awakening children from sleep and can be better heard by people with high frequency hearing deficit which often accompanies advanced age or those exposed to loud sounds for extended periods of time. One of the problems in utilizing such a low frequency (pitch) alarm tone is that it takes significant electrical driving power for a conventional audio output transducer to emit a low frequency alarm tone (for example ~520 Hz) at sound pressure levels of at least 85 dBA at a distance of 10 feet as required by UL 217 and UL 2034 for smoke and carbon monoxide detectors, respectively as non-limiting examples. This problem is compounded when a low frequency alarm tone is desired to be used in a life safety device such as a conventional, environmental condition detector such as a residential or commercial smoke detector or carbon monoxide detector, as non-limiting examples, since such detector unit components including the sound producing elements are typically contained within a thin vented housing a few inches thick (~2-3 inches thick in outside dimension) and approximately four to six inches in diameter or approximately square planform. Due to these geometric constraints (largely for a non-intrusive décor and aesthetics), it is difficult to employ a quarter wave resonant cavity comprising a tube with one open end and one closed end. Based on the theory of acoustics, the length of such a resonant cavity (resonator) is one quarter of a wavelength of the fundamental frequency to obtain resonance which reinforces (amplifies) the sound pressure level output of an audio output transducer (for example a speaker, piezo-speaker, or piezoelectric transducer) acoustically coupled to the resonant cavity. For example, for a fundamental frequency of 520 Hz, a quarter-wave closed end, tubular resonant cavity with an open opposite end (Helmholtz resonator) would theoretically need to be approximately 6.5 inches long for air at standard sea level conditions where the speed of sound is approximately 1120 ft/sec. Practically, however, allowing for end effects of the open end of the resonant cavity, the length of such a quarter-wave resonant cavity is on the order of 5-6 inches, still about twice the dimension of the thickness of a conventional, environmental condition detector. Further, in order to achieve the requisite sound pressure level with conventional battery power used in environmental condition detectors (single 9V alkaline battery or 2 to 4 AA or AAA alkaline batteries for example), the audio output transducer must be of sufficient size (typically at least 1-2 inches in diameter) to adequately acoustically couple to the ambient air. Given this transducer size along with a resonant cavity length on the order of 5-6 inches from the example above, it is easily determined that a linear resonant cavity of this size would occupy so much volume inside the housing of a life safety device configured as a conventional environmental condition detector that it would likely cause major blockage issues with the omni-directional inlet airflow qualities desired in smoke and carbon monoxide detectors for maximum environmental condition sensitivity and/or also result in much larger housing dimensions than are conventional for such life safety devices. Therefore, while a resonant cavity is a very useful element to enhance the sound pressure level of an audio output transducer acoustically coupled to the resonant cavity, it is clear that a conventional, linear quarter wave resonant cavity with one open end and one closed end (Helmholtz resonator) is not as geometrically suitable for conventional shape and size environmental condition detectors as a more compact quarter wave resonant cavity is for this application.

SUMMARY OF THE INVENTION

As described herein, a compact, closed, compliant cavity with a circumferential resonator design is most appropriate to minimize the volume required to acoustically reinforce the sound emitted by an audio output transducer operating at frequency in the range of 400 to 600 Hz. An audio output apparatus described herein comprises an audio output transducer coupled to a compact circumferential acoustic resonator. It is noted that a current trend, in particular for smoke detectors and carbon monoxide detector designs, is to have a smaller overall spatial profile to be less intrusive into the décor of residences and commercial installations. First Alert® model P1000 smoke alarm and model PC900V combination smoke and carbon monoxide alarm are examples of the compact design trends in life safety devices.

In at least one embodiment of the invention, the audio output transducer used in life safety devices is substantially hermetically sealed to a compact circumferential acoustic resonator such that there is no air (gas) exchange or flow between the internal volume of the resonant cavity and the exterior of the cavity in order to maximize amplification of the sound pressure produced by the audio output apparatus. In such an embodiment, a substantially fixed mass of air (or other gas) is maintained within the resonant cavity (a non-Helmholtz resonant cavity or resonator) bounded by the impervious walls of the cavity and the flexible diaphragm or other movable surface of the coupled, audio output transducer. The oscillating, flexible diaphragm (movable surface) in this configuration acts analogously to a reciprocating piston cyclically compressing and expanding air in a piston-cylinder apparatus. The elasticity of the fixed mass of air within the resonant cavity is analogous to a mechanical spring. The use of the terms "substantially fixed mass of air", "substantially hermetically sealed", "substantially air-tight" and similar terms used herein, means that it is intended that the mass of air (gas) within the resonant cavity be captured, fixed, and separated from the ambient air surrounding the resonant cavity, however, minute air leaks (no more than 5% of the volume swept from null position to full amplitude displacement of the diaphragm of the audio output transducer) from the resonant cavity resulting from normal manufacturing variations or imperfections may be tolerated without loss of the intended function or performance. The novel synergistic design of the circumferential resonant cavity with a fundamental natural frequency matching (or very nearly matching) a resonant frequency or harmonic frequency of the coupled audio output transducer is an important feature to permit the emission of low frequency alarm tones at a frequency between 400 to 600 Hz powered by 9V, AA, or AAA batteries while maintaining a compact geometry to fit within conventional size or even compact size life safety devices such as but not limited to residential or commercial smoke and carbon monoxide alarms. Compact size life safety devices are understood to be smaller in external housing dimensions (less than 2 inches thick and less than 4 inches in diameter or square) compared to conventional size life safety devices previously defined as having housings 2-3 inches thick and 4-6 inches in diameter or square. The proper design of the compact circumferential acoustic resonator with a fixed mass of contained air within the resonant cavity is important to provide minimum acoustic impedance to the audio output transducer coupled to the resonator which translates into the maximum sound pressure level emitted by the audio output apparatus per input electrical power to the apparatus (maximum efficiency). The audio output apparatus is, thus, designed to have maximum efficiency while operating at one specific frequency typically achieved when a resonant frequency of the audio output transducer matches a resonant frequency of the compact circumferential acoustic resonator.

DETAILED DESCRIPTION

Figure 1:
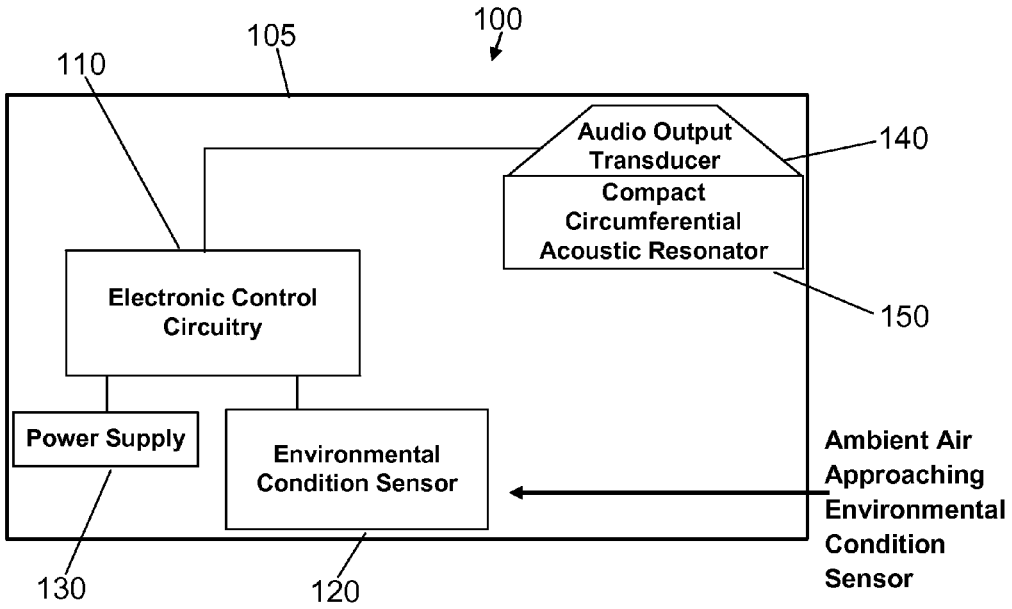
FIG. 1 is a block diagram of the life safety device with compact circumferential acoustic resonator.

A life safety device with a compact circumferential acoustic resonant cavity 100 (also called compact circumferential acoustic resonator) for amplification of low frequency alarm tones is described herein. FIG. 1 illustrates the components of such a life safety device with a compact circumferential acoustic resonator 100 in a block diagram. The electronic control circuitry 110 comprises at least one ASIC in one embodiment and a programmable microprocessor in another embodiment. The electronic control circuitry 110 manages the overall functions of the life safety device 100 as is well known in the art, such as determining when the environmental condition sensor 120 has sensed a potentially hazardous condition and sending an electronic signal to be output through an audio output transducer 140 as alarm tones when an environmental condition has been sensed. The electronic circuitry 110 comprising a microprocessor is programmed to electronically read an electronic signal from the environmental condition sensor 120 and to determine when a predetermined data threshold is met or exceeded indicating an environmental condition exists. The environmental condition sensor 120 comprises sensors known in the art of life safety devices such as, but not limited to, a smoke sensor, a fire sensor, a temperature sensor, a gas sensor, a carbon monoxide sensor, an intrusion sensor, vibration sensor, a glass break sensor, a motion sensor, a water sensor, etc. More than one environmental condition sensor 120 can be connected to the electronic control circuitry 110 in the life safety device 100 in at least one embodiment.

Figure 2:
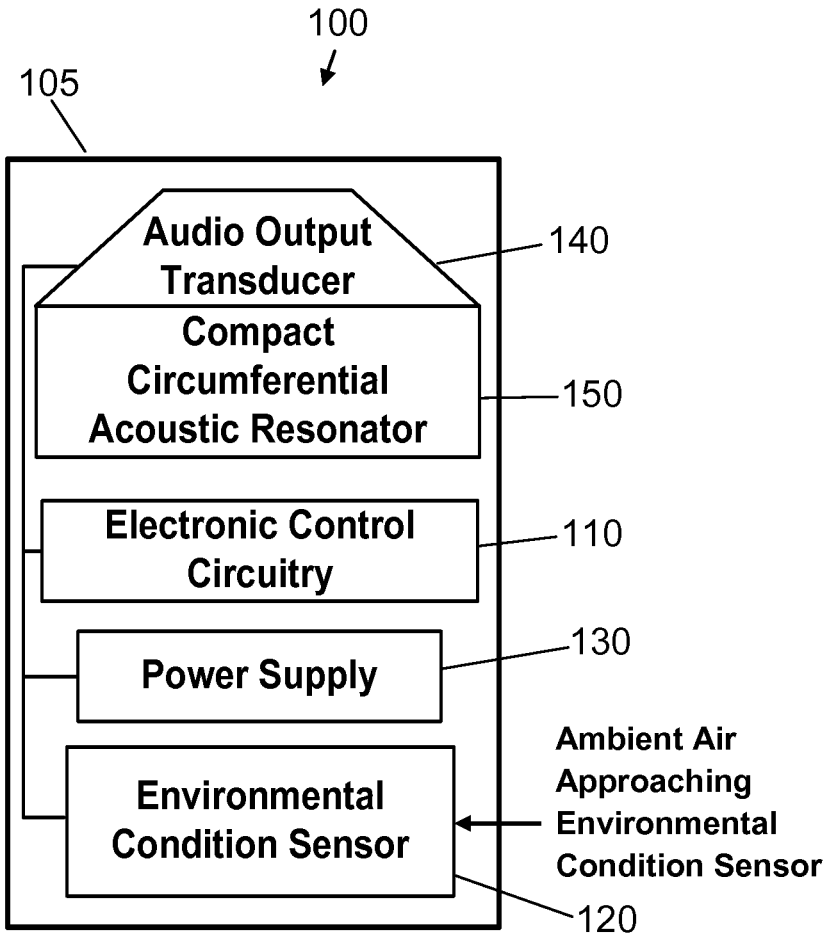
FIG. 2 is a block diagram of the life safety device with compact circumferential acoustic resonator in a stacked component configuration.

The environmental condition sensor 120, the power supply 130, and the audio output transducer 140 are electronically connected to the electronic control circuitry 110. FIG. 1 shows that the compact nature of the compact circumferential acoustic resonator 150 permits the housing 105 of a conventional size or compact size and shape life safety device 100 configured as a environmental condition detector (for example, smoke and/or carbon monoxide detector) to contain the audio output apparatus 135 for producing low frequency alarm tones (on the order of 520 Hz fundamental frequency in one embodiment where "on the order of" is defined as a frequency within the range 400 Hz to 600 Hz) while not impeding the ambient air flow approaching the environmental condition sensor 120 from any direction. It is noted that for smoke detectors and carbon monoxide detectors, holes in the housing 105, often around the housing periphery (vented housing), permit ambient air and airborne hazardous substances to move into the environmental condition sensor 120 from any direction for maximum sensitivity and safety. Therefore, one novel advantage of the small size of the compact circumferential acoustic resonator 150 disclosed herein is the synergistic effect of using a closed, compact, quarter-wave, acoustic resonant cavity (compliant cavity or non-Helmholtz cavity) to amplify sound pressure levels of the audio output transducer 140 while fitting within a housing 105 approximately 2 to 3 inches thick and approximately 3-6 inches in diameter or smaller without significantly degrading the directional sensitivity of the environmental condition sensor 120. Alternatively, the small size of the compact circumferential acoustic resonant cavity 150 permits a stacked arrangement of components with the life safety device 100 such that the components may be positioned within a housing 105 approximately 3 inches thick (tall) and 2.5 to 3.5 inches in diameter as is illustrated in FIG. 2.

Figure 5:
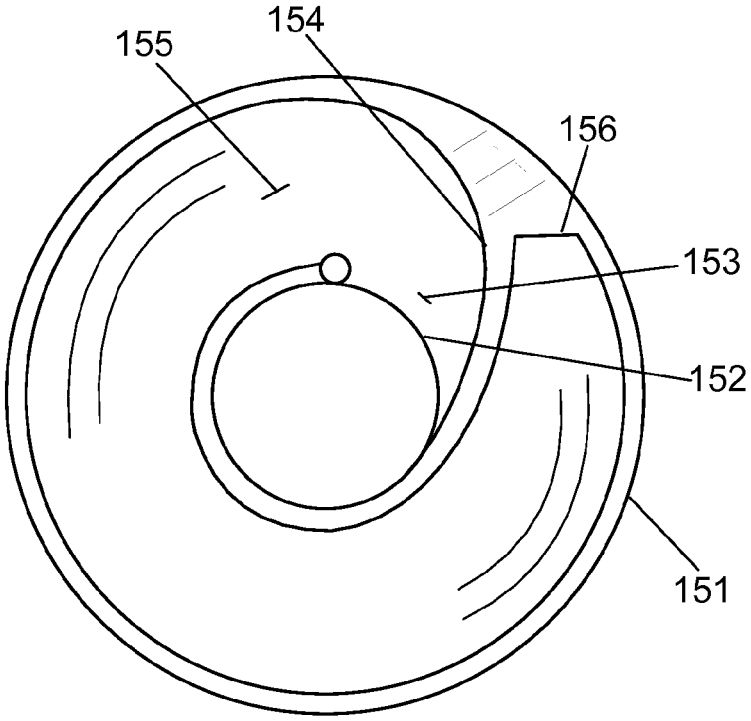
FIG. 5 shows a bottom view of the circumferential channel section of the compact circumferential acoustic resonator.
Figure 7:
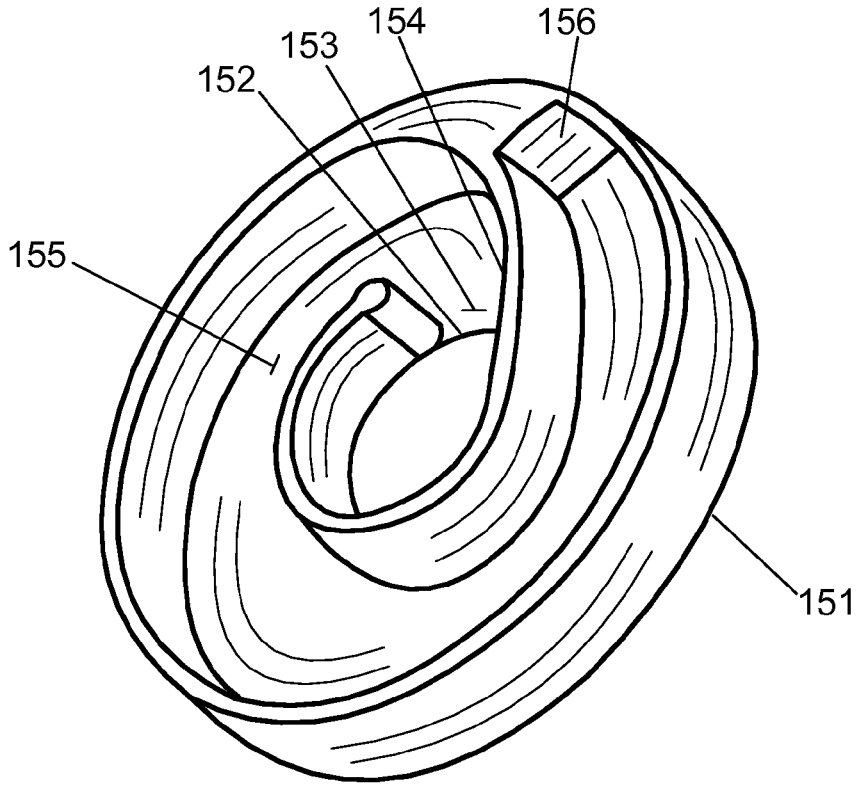
FIG. 7 shows a bottom perspective view of the circumferential channel section of the compact circumferential acoustic resonator.
Figure 11:
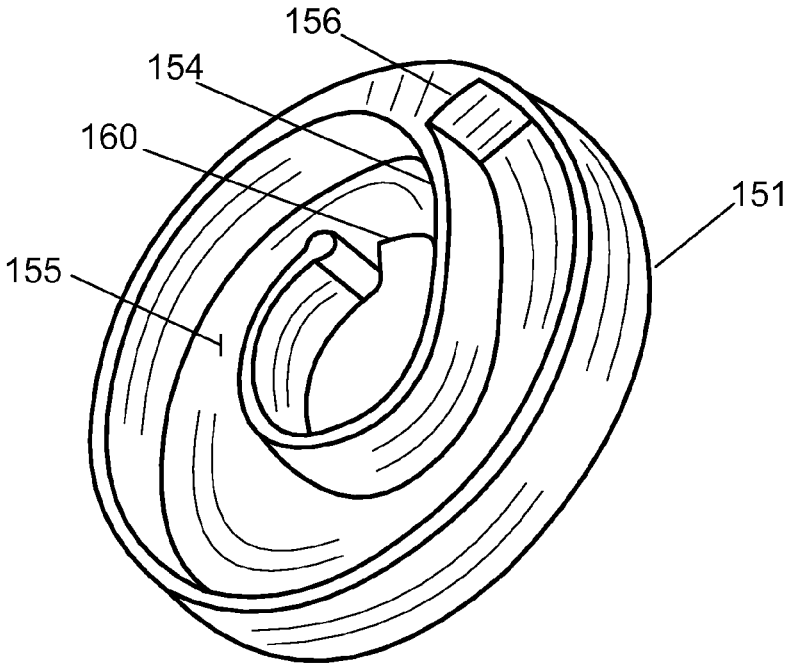
FIG. 11 shows a bottom perspective view of the circumferential channel section of the compact circumferential acoustic resonator with an elongated transducer coupling port.

The closed, compact circumferential acoustic resonator 150 operates on a similar acoustic principle as a conventional, quarter wave resonant cavity, in that each resonant cavity type has one node and one antinode separated by approximately one quarter of the wavelength associated with the fundamental frequency of the sound wave being reinforced or amplified. However, for the compact circumferential acoustic resonator 150 described herein, the path between the node and antinode follows, at least in part, a ring-shaped passage (acoustic wave guide) as shown in FIGS. 5, 7 and 11. It is noted that use of the term "ring shaped" or "ring shaped cavity" herein means shaped like a ring or partial ring, but does not necessarily mean a continuous path completing a full 360 degrees or more. For some embodiments of the compact circumferential acoustic resonator 150, the ring shaped cavity 155 may include an arcuate passage subtending an angle equal to or greater than 360 degrees, but other embodiments may include an arcuate passage in the ring shaped cavity 155 subtending an angle less than 360 degrees.

In an alternate embodiment, the ring shaped cavity 155 can be helical to achieve significantly more than 360 degree of acoustic path length within a compact volume. A helical ring shaped cavity 155 allows for spirals in the geometry of circumferential channel section 151 such that the bottom wall of a first channel section forms the top wall of a second channel section spiraled beneath the first. In this embodiment, a node forming wall 156 is positioned at the distal end of the ring shaped cavity 155 formed into a helix.

It is also noted that the terms "node" and "antinode" used herein refer to particle displacement nodes and particle displacement antinodes of sound waves unless otherwise specified. Sound waves are known to be longitudinal waves.

The power supply 130 shown in FIG. 1 is a battery power supply (9V alkaline, AA alkaline, AAA alkaline, or long-life lithium batteries as non-limiting examples), a wired alternating current power supply, a wired direct current power supply, or a wired power supply with a battery back-up in the various embodiments. In one embodiment of the invention, the power supply 130 comprises a battery powered supply with a DC to DC step-up converter to maintain or increase the battery supply voltage to drive the audio output transducer 140 coupled to the compact circumferential acoustic resonator 150 as the battery cell voltage drops over time and with use.

Figure 3:
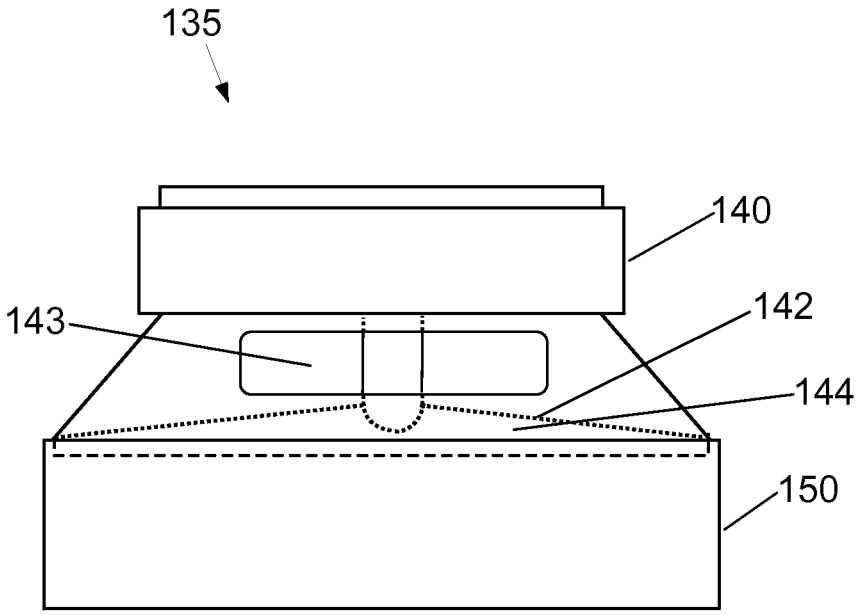
FIG. 3 shows a side view of the audio output apparatus comprising an audio output transducer and a compact circumferential acoustic resonator.

FIG. 3 shows an embodiment of the audio output apparatus 135 comprising a compact circumferential acoustic resonator 150 acoustically coupled to an audio output transducer 140 (speaker, piezoelectric transducer, piezo-speaker, or mechanical transducer as non-limiting examples). The outer edge of the audio output transducer 140 is sealed to the rim on the top of the compact circumferential acoustic resonator 150. One embodiment includes a raised lip 159 around the rim of the top of the compact circumferential acoustic resonator 150 (see FIG. 10) to facilitate fastening and sealing the audio output transducer 140 to a compact circumferential acoustic resonator 150 thereby forming a closed volume between the internal passages of the compact circumferential acoustic resonator 150 and the movable surface 142 (speaker diaphragm in one embodiment) of the audio output transducer 140. The movable surface 142 of the audio output transducer 140 has an inner face that is acoustically coupled to captured air 144 inside the compact circumferential acoustic resonator 150 and an outer face that is acoustically coupled to the ambient air 143 surrounding the audio output transducer 140. In common embodiments of speakers, the movable surface 142 is made of paper, mylar, plastic, metal, or other known thin, flexible material used for speaker diaphragms known in the art.

In one embodiment, the outer thickness (height from top to bottom as viewed in FIG. 3) of the compact circumferential acoustic resonator 150 is 0.5 inch with an outer diameter of 2.5 inches. The wall thickness of the compact circumferential acoustic resonator 150 in one embodiment is 0.080 inch. In one embodiment, the audio output transducer 140 is a speaker (as shown) with a diameter on the order of 2.25 inches and a thickness on the order of 1 inch. Therefore, for one non-limiting embodiment shown, the thickness (height as shown from top to bottom in FIG. 3) of the audio output apparatus 135 is 1.5 inches. Therefore, the outer dimensional volume of the audio output transducer 140 (CUI GF0573 loudspeaker in one embodiment) added to the outer dimensional volume of the compact circumferential acoustic resonator 150 in one embodiment yields a total volume of three cubic inches. Thinner audio output transducers could further reduce the overall thickness of the audio output apparatus 135.

In one embodiment, the compact circumferential acoustic resonator 150 is comprised of a circumferential channel section 151 and a seal plate 157 assembled to form an internal, ring shaped cavity 155. In other embodiments, the compact circumferential acoustic resonator 150 including the internal, ring shaped cavity 155 is manufactured in a unitary piece with the equivalent of a circumferential channel section 151 and a seal plate 157. Example manufacturing processes that may be used for such a one-piece construction includes injection molding and additive manufacturing. Those having skill in the art of manufacturing hollow geometries will recognize other known manufacturing methods to construct the compact circumferential acoustic resonator 150 including the internal, ring shaped cavity 155, and such methods are intended to be included herein. The method of manufacture of the compact circumferential acoustic resonator 150 including the internal, ring shaped cavity 155 is not intended to be limiting nor are the various components of the compact circumferential acoustic resonator 150 described herein intended to be limiting on how to manufacture a compact circumferential acoustic resonator 150 with an internal, ring shaped cavity 155. The final geometric structure of the compact circumferential acoustic resonator 150 is of central importance to how it functions rather than how it is manufactured or assembled.

Figure 4:
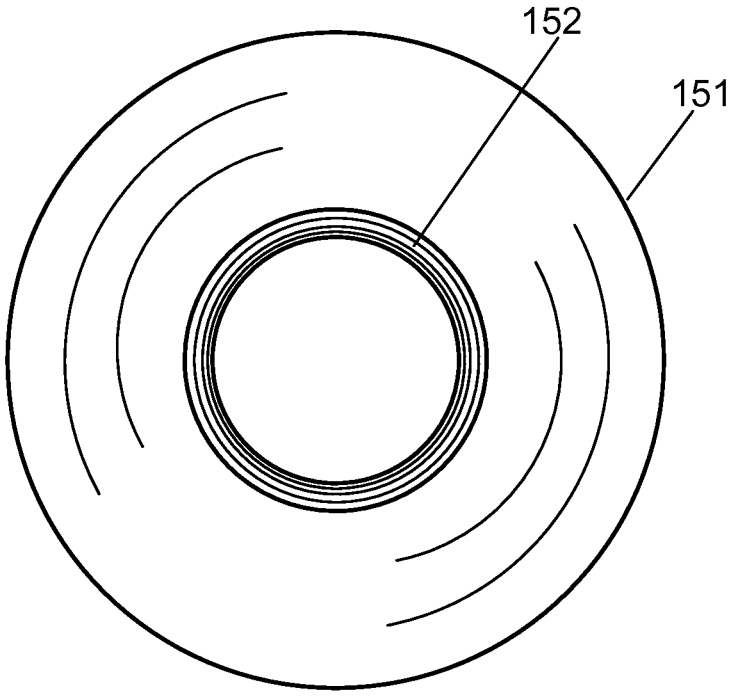
FIG. 4 shows a top view of the circumferential channel section of the compact circumferential acoustic resonator.
Figure 6:
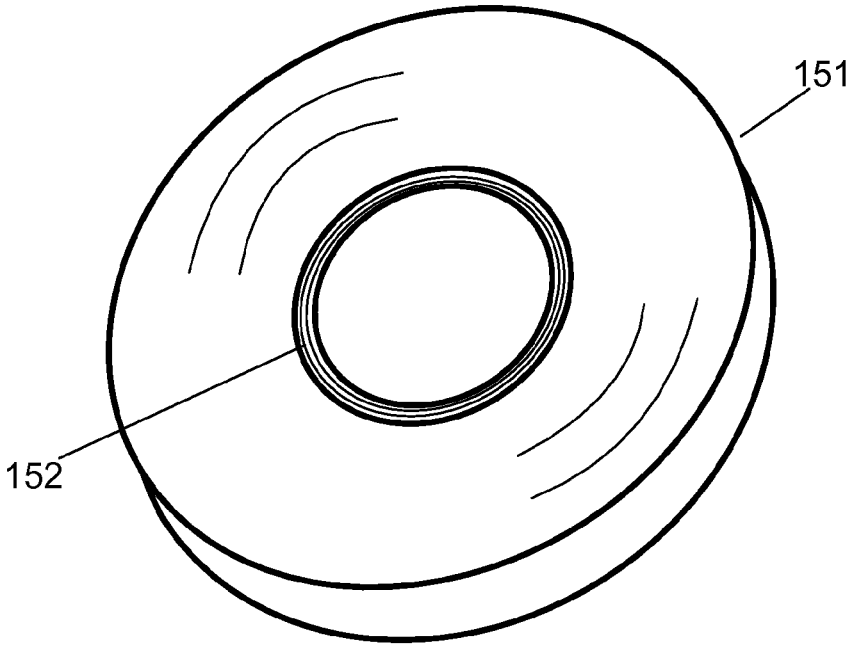
FIG. 6 shows a top perspective view of the circumferential channel section of the compact circumferential acoustic resonator.

A top view and bottom view of circumferential channel section 151 of the compact circumferential acoustic resonator 150 are shown in FIG. 4 and FIG. 5, respectively. A perspective top view and a perspective bottom view of the circumferential channel section 151 of the compact circumferential acoustic resonator 150 are shown in FIG. 6 and FIG. 7, respectively. The top outer surface of the circumferential channel section 151 mates to the audio output transducer 140 which is acoustically coupled to the ring-shaped cavity 155 through the transducer coupling port 152. The transducer coupling port 152 is a hole through the top surface of the circumferential channel section 151 through which the acoustic waves emitted from the audio output transducer 140 are directed towards the seal plate 157 to be further directed through the radial port 153 at the proximal end of the ring shaped cavity 155. The radial port 153 serves as the acoustic entry to the proximal end of the ring shaped cavity 155 where the acoustic waves move radially outward from the center of the transducer coupling port 152. The acoustic wave deflector 154 is a solid partition which directs the acoustic wave emitted from the audio output transducer 140 and passing through the transducer coupling port 152, in a preferential circumferential path near the proximal end of the ring-shaped cavity 155 formed between the circumferential channel section 151 of the compact circumferential acoustic resonator 150 and the seal plate 157 in one embodiment. The internal passages of the compact circumferential acoustic resonator 150 comprise the transducer coupling port 152, the center tapered duct 158 (optional), the radial port 153, and the ring shaped cavity 155.

Figure 8:
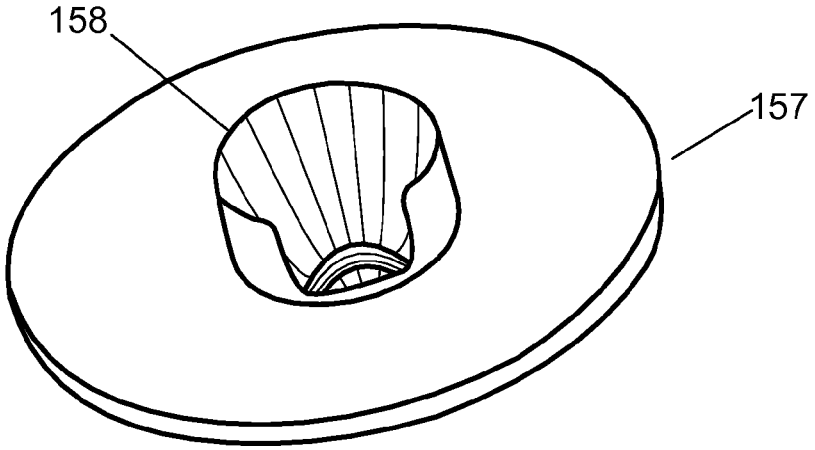
FIG. 8 shows a top perspective view of the seal plate.
Figure 9:
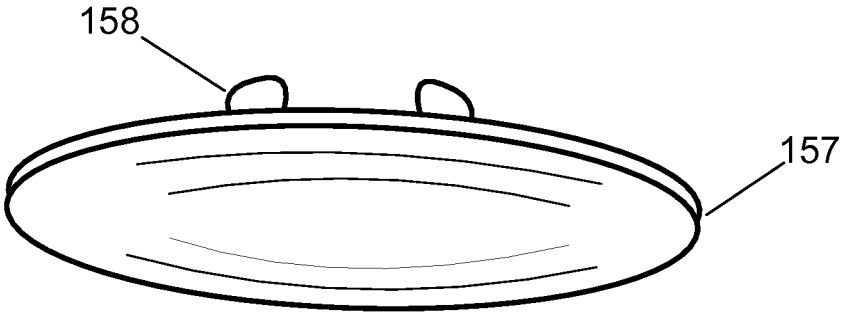
FIG. 9 shows a bottom perspective view of the seal plate.

A perspective top view and perspective bottom view of the seal plate 157 are shown in FIG. 8 and FIG. 9, respectively. The seal plate 157 is comprised of a thin circular disk with a center tapered duct 158 which extends inside of the transducer coupling port 152 when the seal plate 157 is mated to the circumferential channel section 151 of the compact circumferential acoustic resonator 150. The center tapered duct 158 of the seal plate 157 helps to direct the acoustic wave emanating from the audio output transducer 140 into a radial port 153 providing acoustic communication between the circumferential channel section 151 of the compact circumferential acoustic resonator 150 and the transducer coupling port 152. In another embodiment, the seal plate 157 comprises a flat, thin circular disk with no center tapered duct 158. It is understood that without loss of function in another embodiment, the seal plate 157 can be manufactured integral to the compact circumferential acoustic resonator 150 as an overall, unitary construction or the circumferential channel section 151 of the compact circumferential acoustic resonator 150 may include the seal plate 157 as an integral component while the top of the circumferential channel section 151 of the compact circumferential acoustic resonator 150 can be a separate, thin annular disk which is then attached to form a closed circumferential cavity. Again, it is understood that how the resonator geometry is manufactured and/or assembled is not intended to be limited by the embodiments shown herein. A preferred embodiment of the compact circumferential acoustic resonator 150 comprises a transducer coupling port 152 acoustically coupled to a radial port 153, in turn, acoustically coupled to a ring shaped cavity 155 having a proximal end and a distal end whereby a node forming wall 156 is positioned at the distal end of the ring shaped cavity 155.

Figure 10:
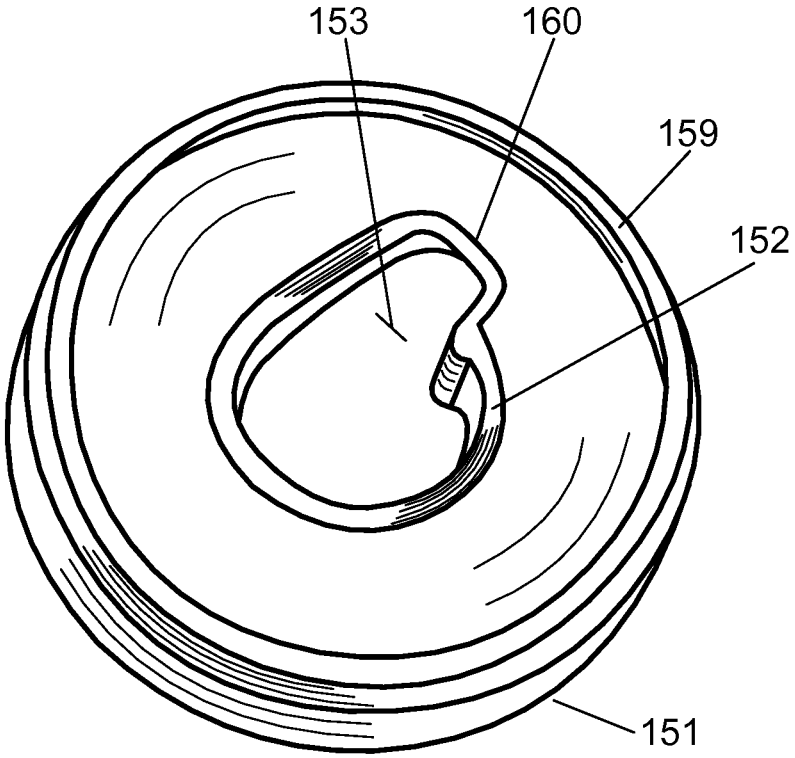
FIG. 10 shows a top perspective view of the circumferential channel section of the compact circumferential acoustic resonator with an elongated transducer coupling port.

FIG. 10 shows a top perspective view of the circumferential channel section 151 of the compact circumferential acoustic resonator 150 with an elongated transducer coupling port 160 in one embodiment to increase the coupling volume between the audio output transducer 140 and the ring-shaped cavity 155 thereby increasing acoustic performance. This embodiment also illustrates a lip 159 on the outer top surface of the circumferential channel section 151 to facilitate securing and sealing the audio output transducer 140 to the compact circumferential acoustic resonator 150. FIG. 11 shows the bottom perspective view of the circumferential channel section 151 of the compact circumferential acoustic resonator 150 with an elongated transducer coupling port 160 in one embodiment.

Figure 12:
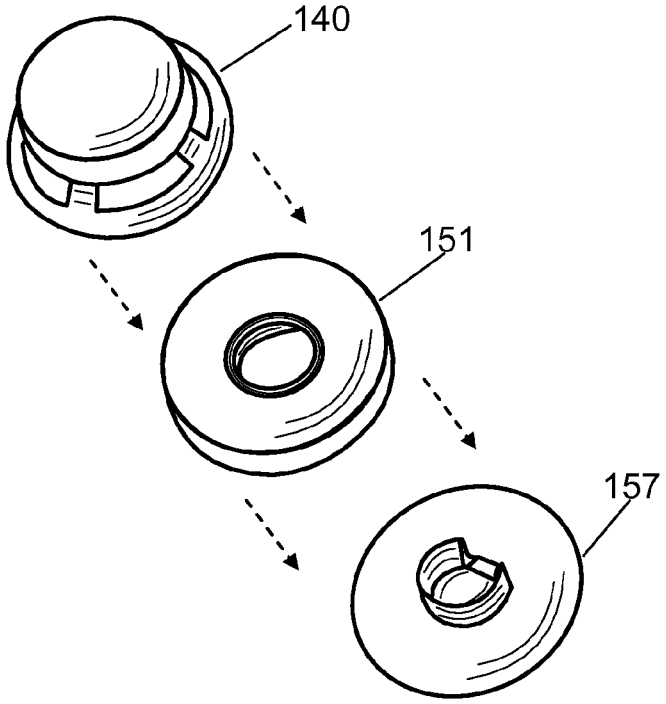
FIG. 12 shows a perspective view of how the audio output transducer and the compact circumferential acoustic cavity are assembled in one non-limiting embodiment.
Figure 13:
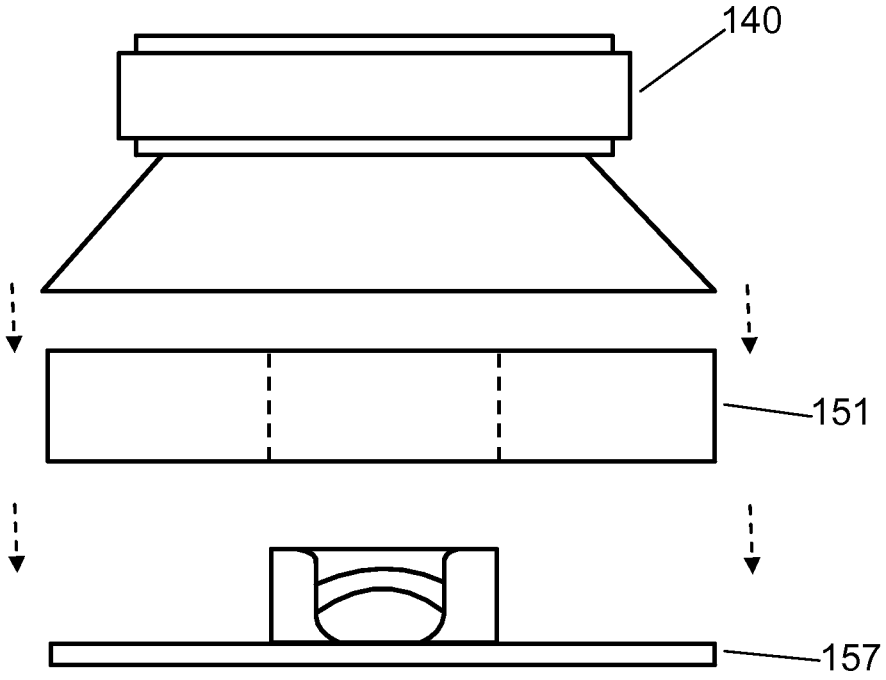
FIG. 13 shows a side view of how the audio output transducer and the compact circumferential acoustic resonator are assembled in one non-limiting embodiment.

FIG. 12 is a perspective view illustrating how the audio output transducer 140, the circumferential channel section 151 of the compact circumferential acoustic resonator 150, and the seal plate 157 are assembled to form an integral audio output apparatus 135 with a sealed, compact circumferential cavity in one embodiment of the invention. FIG. 13 is a side view illustrating how the audio output transducer 140, the circumferential channel section 151 of the compact circumferential acoustic resonator 150, and the seal plate 157 are assembled to form the audio output apparatus 135. FIG. 3 shows the assembled audio output transducer 140 with a compact circumferential acoustic resonator 150 to form a completed low frequency, audio output apparatus 135 with a frequency partially defined by the length of an acoustic path starting at the center of the movable surface 142 of the audio output transducer 140 (antinode) and extending to the node forming wall 156 along the acoustic path through the transducer coupling port 152, through the radial port 153, and around the ring-shaped cavity 155 to the node forming wall 156 at the distal end of the ring-shaped cavity 155. For at least one embodiment of the audio output apparatus 135, the length of the acoustic path is 6.25 inches (using the mid-radius of 0.84 inches of the ring shaped cavity 155 and 0.64 inches of linear distance from the center of the movable surface 142 to the center surface of the seal plate 157, or its equivalent, facing the transducer coupling port 152) which translates to a resonant frequency (quarter-wave resonator) of approximately 520 Hz in air for the audio output apparatus 135.

The compact circumferential acoustic resonator 150 comprises a transducer coupling port 152, a radial port 153, a seal plate 157, an acoustic wave deflector 154, and a ring-shaped cavity 155 whereby the axial acoustic waves emanating from the audio output transducer 140 traverse the audio transducer coupling port 152 and are directed into the proximal end of the ring-shaped cavity 155 through a radial port 153 and past the acoustic wave deflector 154 where the axial acoustic waves are transformed into tangential acoustic waves by the geometry of the passages within the compact circumferential acoustic resonator 150. The tangential acoustic waves are reflected off a node forming wall 156 at the distal end of the ring-shaped cavity 155, the node forming wall 156 positioned perpendicular to the tangential wave direction of motion. In a properly designed compact circumferential acoustic resonator 150, no nodes are established along the acoustic path within the resonator except at the distal end of the ring shaped cavity 155 at the node forming wall 156. If unintended nodes were to be formed along the acoustic path within the compact circumferential acoustic resonator 150 upstream of the node forming wall 156, reflected waves from the unintended nodes may result in unacceptable sound output as determined from an acoustic spectral analysis described in the UL Standards for audible alarms of life safety devices (for example, UL 217 for smoke alarms-alarm audibility specifications). It is to be understood that the use of words "axial" and "tangential" both refer to conventional longitudinal acoustic wave modes, however "axial" describes the direction of travel of the longitudinal acoustic waves traveling approximately perpendicular to a diaphragm or similar oscillating surface of an audio output transducer 140 acoustically coupled to the compact circumferential acoustic resonator 150 and "tangential" describes the circumferential direction of travel of the longitudinal acoustic waves within the ring-shaped cavity 155.

Acoustic compression waves travel away from the audio output transducer 140 (incidence waves), move through the transducer coupling port 152, the radial port 153, and the ring shaped cavity 155, reflect off the node forming wall 156 (reflected waves) and reverse direction as acoustic compression waves and travel back through the ring shaped cavity 155, the radial port 153, and the transducer coupling 152 port to reach the audio output transducer 140. This same process also occurs for acoustic rarefaction waves traveling from the audio output transducer 140. At resonance, incident waves and reflected waves interact to form a standing wave pattern within the quarter-wave, compact circumferential acoustic resonator thereby minimizing the acoustic impedance experienced by the audio output transducer 140 coupled to the compact circumferential acoustic resonator 150 when the audio output transducer 140 is driven at or near a resonant frequency (fundamental frequency or harmonic frequency) of the resonator. The compact circumferential acoustic resonator 150 is in acoustic resonance when a standing acoustic wave is present within thereby strengthening the sound pressure level emitted from the audio output transducer 140 compared to the audio output transducer 140 operating alone with the same electrical power driving the audio output transducer 140. The resonance mode with the loudest sound output from the audio output apparatus 135 with the least electrical driving power required occurs when a natural resonant frequency of the audio output transducer 140 matches a natural resonant frequency of the compact circumferential acoustic resonator 150. While the matching of the resonant frequencies of an audio output transducer 140 and a resonant cavity is the most energy efficient way to employ resonators to produce a fixed frequency of sound needed for tonal output in life safety devices, other applications of sound generation focus on a wide bandwidth of the acoustic spectrum and try to avoid resonance between an audio transducer and a resonant cavity or speaker enclosure due to unwanted amplitude responses at certain frequencies of sound generated. When the audio output apparatus 135 is operating in resonance, the movable surface 142 oscillates at higher displacement amplitudes than when the audio output apparatus 135 is operating in a non-resonance mode with the same electrical power driving the audio output transducer 140. This low impedance coupling of the audio output transducer 140 with the compact circumferential acoustic resonator 150 provides increased sound pressure levels emitted compared to the audio output transducer 140 alone. When the audio output transducer 140 is mated to the compact circumferential acoustic resonator 150, the resulting cavity becomes a sealed, fixed air mass, compliant cavity with no open ports to the atmosphere within the resonator, therefore it is not a Helmholtz resonator. When standing acoustic waves are established within the compact circumferential acoustic resonator 150, a node exists at the node forming wall 156 and an anti-node is formed at the movable surface 142 of the audio output transducer 140. The side of the movable surface 142 of the audio output transducer 140 acoustically coupled to the ambient air 143 (opposite side of the movable surface 142 facing the compact circumferential acoustic resonator 150) produces a significant portion of the sound pressure level emanating from the audio output apparatus 135.

During acoustic resonance of the audio output apparatus 135, a standing acoustic wave is contained by the compact circumferential acoustic resonator 150 such that the standing acoustic wave is comprised of an axial wave portion and a tangential wave portion, as described above, when the audio output transducer 140 emits a tone to acoustically excite the compact circumferential acoustic resonator 150. In one embodiment, the tangential wave portion traverses at least 180 degrees of the ring shaped cavity 155 to take advantage of the compact geometry the ring shaped cavity 155 provides in terms of reducing the thickness of the compact circumferential acoustic resonator 150. In other embodiments, the tangential wave portion traverses more than 360 degrees of the ring shaped cavity 155. In general, the larger the ratio of the path length of the tangential wave portion to the path length of the axial wave portion of the standing acoustic wave, the more compact (thinner) the audio output apparatus 135 is for a given audio output transducer 140 and operation at a given resonant frequency. For one embodiment, this path length ratio (PLR) is 8.76 as calculated by Tangential Wave Portion Path Length/Axial Wave Portion Path Length=$\theta R/L=(2.125\pi)(0.84\text{ in})/(0.64\text{ in.})$, where $\theta$ is the angle subtended by the ring shaped cavity 155, R is the mid-radius of the ring shaped cavity 155 and L is the axial wave portion path length. In this example embodiment, the ring shaped cavity 155 subtends an arc of $2.125\pi$ radians (382.5 degrees). One of the preferred embodiments of the audio output apparatus 135 has a PLR of at least 8.76 operating at a frequency on the order of 520 Hz.

In order to achieve a practical level of compactness for an audio output apparatus 135 implemented in a conventional or compact life safety device such as, but not limited to, smoke and carbon monoxide detectors, the PLR should have a value of at least 2, which translates to the path length of the tangential wave portion being at least twice the path length of the axial wave portion. For example, an audio output apparatus 135 with a PLR of 2 driven by a thin audio output transducer 140 producing a tone on the order of 520 Hz will fit inside a 2.5 inch thick (tall) housing. Audio output transducers 140 used in smoke and carbon monoxide alarms, as examples, are typically positioned within a housing 105 so that the movable surface 142 is effectively parallel with the base of the housing 105 to produce omni-directional sound propagation away from the life safety device. For the above example, the path length of the tangential wave portion is 4.16 inches, and the path length of the axial wave portion is 2.08 inches using a quarter-wave, compact circumferential acoustic resonator 150. If the thickness of the selected audio output transducer 140 increases, the PLR must also increase (path length of the axial wave portion must decrease) in order for the thickness (height) of the audio output apparatus 135 to remain the same to fit within the same thickness housing. This is the case since for a thicker audio output transducer 140, the axial wave portion path length must be reduced due to spatial limitations in the direction of the axial wave portion path imposed by a fixed housing thickness (height).

In one non-limiting prototype embodiment, the outer diameter of the compact circumferential acoustic resonator 150 is 2.5 inches, the outer thickness is 0.5 inches, and the transducer coupling port 152 is 0.9 inches in diameter. In one preferred embodiment, the outer thickness of the compact circumferential acoustic resonator 150 is less than or equal to 0.5 inches and the outer diameter of the compact circumferential acoustic resonator 150 is less than or equal to 2.5 inches to achieve a level of compactness such that the audio output apparatus 135 will fit inside a conventional size housing of a smoke or carbon monoxide detector.

As described above, in order to maximize the sound pressure level output from the audio output apparatus 135 for a given input signal power driving the audio output transducer 140, a resonant frequency of the audio output transducer 140 should be the same as a resonant frequency (or harmonic) of the quarter wave, compact circumferential acoustic resonator 150. This resonant frequency matching maximizes the powered absorbed by the compact circumferential acoustic resonator 150 which results in the largest amplitude oscillation of the movable surface 142 of the audio output transducer 140 providing the largest sound pressure level emanating from the audio output apparatus 135 for a given electrical driving power. As one non-limiting example, a CUI GF0573 speaker with a 2.25 inch (57 mm) outer diameter was coupled to the compact circumferential acoustic resonator 150, and testing revealed sound pressure levels exceeding 85 dBA measured in an anechoic chamber at a distance of 10 feet from the audio output apparatus 135 with 1.7 watts of power driving the audio output transducer 140 with a 520 Hz symmetric square wave (see FIG. 14). A resonant frequency of the CUI GF0573 speaker matches closely with a resonant frequency of an embodiment of the quarter-wave, compact circumferential acoustic resonator 150 used to produce the test results in FIG. 14.

Tests of the audio output apparatus 135 amplified the sound pressure level by as much as 10 dBA at a distance of 10 feet away in an anechoic chamber compared to the audio transducer 140 alone when driven with a 520 Hz symmetric square wave at the same electrical power input.

For all of the embodiments disclosed herein, a significant, synergistic, acoustic effect is created when a natural frequency of the audio output transducer 140 matches a natural frequency of the compact circumferential acoustic resonator 150. At that operational point, optimum sound pressure level and sound power are emitted from the audio output apparatus 135 for a minimum power input to the audio output transducer 140 at very specific frequencies (resonant frequency and harmonic frequencies of the resonant cavity). This minimum power input with maximum sound pressure level output coupled with a compact acoustic geometry has great utility for battery operated or battery back-up life safety devices such as, but not limited to, residential smoke alarms and carbon monoxide alarms. One of the novel aspects of the embodiments of the instant invention is that for very specific acoustic frequencies, a properly designed audio output apparatus 135 will provide the optimum cavity performance index (CPI in dBA/W-cm$^3$) of sound pressure level output per power input per volume of the resonant cavity producing low frequency alarm tones. Here, the sound pressure level is measured in dBA at a distance of 10 ft (~3.05 m) in an anechoic chamber, the power input is the electrical power in watts (normally a square waveform input signal with a ~50% duty cycle) driving the audio output transducer 140 coupled to the compact circumferential acoustic resonator 150, and the volume of the resonant cavity is the external geometry volume in cubic centimeters of the compact circumferential acoustic resonator 150. The larger the numerical value CPI is for the audio output apparatus 135 disclosed herein or other audio output apparatuses, the better the audio output apparatus 135 is for use in conventional size and compact size life safety devices such as, but not limited to, smoke alarms and carbon monoxide alarms. The larger the numerical value for CPI of an audio output apparatus 135, the better the apparatus is suited for simultaneously satisfying important criteria of this invention, namely compactness and power efficiency of an audio output apparatus 135 for life safety devices. The life safety devices required to output low frequency alarm tones should be as small as possible and output the alarm tone as energy efficiently as possible when a potentially hazardous condition is sensed. For one embodiment with a compact circumferential acoustic resonator 150 with an outside diameter of 2.5 inches and an external thickness (height) of 0.5 inches (external volume of the resonator=(thickness)(diameter)$^2\pi/4$=2.45 in$^3$=40.2 cm$^3$) producing a sound pressure level of 87 dBA at a distance of 10 feet inside an anechoic chamber while the coupled audio output transducer 140 is driven by 1.7 watts of power, the CPI is calculated to be 1.27 dBA/(W-cm$^3$). A CPI value of at least 1.27 dBA/(W-cm$^3$) is considered to be an effective compact resonator suitable for use in conventional size life safety devices emitting low frequency alarm tones such as a smoke detector, a carbon monoxide detector, or a combination smoke and carbon monoxide detector as non-limiting examples. A CPI value of at least 1.27 dBA/(W-cm$^3$) was found to be practical for use in prototype life safety devices enclosed by a housing 105 less than 2.5 inches thick (high) and less than or equal to 4 inches in diameter.

Figure 14:
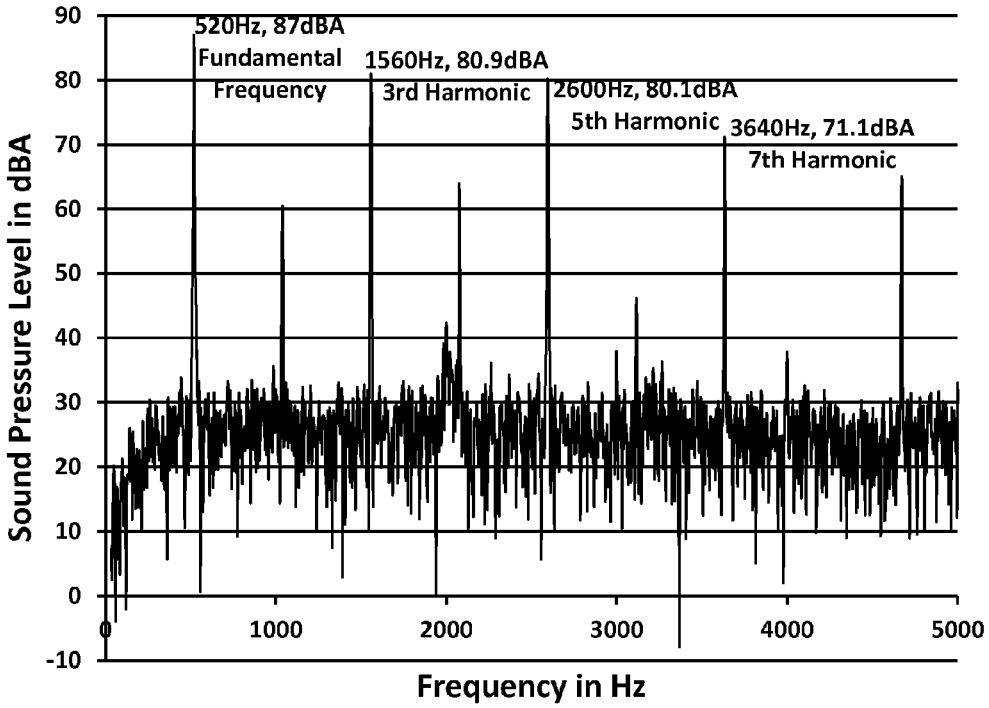
FIG. 14 shows a Fast Fourier Transform (FFT) of the audio performance of one embodiment of the audio output apparatus driven by a square wave at 520 Hz at 10 ft from a microphone in an anechoic chamber.

FIG. 14 shows testing results of the audio output apparatus 135 mounted to a 2 ft×2 ft×0.75 in plywood board positioned in an anechoic chamber with a microphone located at 10 ft from the apparatus. The Fast Fourier Transform (FFT) shows that the acoustic spectral response for a fundamental square wave frequency of 520 Hz. The voltage at the terminals of the audio output transducer 140 was 7.7 $V_{rms}$ for this test. The test shows that the odd harmonics all peak at more than 6 dBA below the peak sound pressure level of 87 dBA at the fundamental frequency for the test results shown.

The various embodiments described above are merely descriptive and are in no way intended to limit the scope of the invention. The physical dimensions provided herein are for example only and are not intended to limit the scope of the embodiments of the invention. It is understood that the circumferential geometry of the compact circumferential acoustic resonator 150 described herein is an important factor in the proper operation of this invention, and construction of the same or similar geometry by the use of different components, materials, or manufacturing methods than those described herein resulting in the same or similar geometry are intended to fall within the scope of this invention. Modification will become obvious to those skilled in the art in light of the detailed description above, and such modifications are intended to fall within the scope of the appended claims.

I claim:

1. A life safety device comprising:

electronic control circuitry;

a sensor connected to the electronic circuitry;

an audio output apparatus comprising an audio output transducer acoustically coupled to a compact circumferential acoustic resonator;

the electronic circuitry drives the audio output apparatus to emit a tone when the sensor senses an environmental condition;

the compact circumferential acoustic resonator comprises a transducer coupling port and a ring-shaped cavity, having a proximal end and a distal end, wherein axial acoustic waves emitted from the audio output transducer traverse a transducer coupling port and are directed through the radial port into the ring-shaped cavity where the axial acoustic waves are transformed into tangential acoustic waves;

the tangential acoustic waves reflect off a node forming wall at the distal end of the ring shaped cavity, the node forming wall oriented perpendicular to direction of motion of the tangential acoustic waves; and the sensor comprises one of a smoke sensor, a carbon monoxide sensor, a natural gas sensor, an intrusion sensor, a glass break sensor, a temperature sensor, or a vibration sensor.

2. The life safety device as in claim 1 wherein the tone is on the order of 520 Hz fundamental frequency.

3. The life safety device as in claim 2 wherein the audio output apparatus has a cavity performance index of at least 1.27 dBA/W-cm3.

4. A life safety device comprising:

electronic control circuitry;

a sensor connected to the electronic control circuitry;

an audio output apparatus comprising an audio output transducer acoustically coupled to a compact circumferential acoustic resonator thereby forming a substantially air tight, compliant cavity with a resonant frequency on the order of 520 Hz;

the compact circumferential acoustic resonator comprises a ring-shaped cavity, for guiding tangential acoustic waves, the ring-shaped cavity comprising a proximal end and a distal end, wherein the ring-shaped cavity is closed at the distal end; and the audio output apparatus emits a tone on the order of 520 Hz when the sensor senses an environmental condition.

5. The life safety device as in claim 4 wherein a vented housing, having a periphery with holes, encloses the electronic control circuitry, the sensor, and the audio output apparatus; and the audio output apparatus positioned relative to the sensor such that ambient air and airborne substances, approaching the periphery of the vented housing from any direction, enter the sensor unimpeded by the audio output apparatus.

6. The life safety device as in claim 4 wherein the compact circumferential acoustic resonator further comprises a transducer coupling port and a radial port, wherein the diameter of the transducer coupling port is on the order 40% of the outer diameter of the audio output transducer.

7. The life safety device as in claim 4 in which the audio output apparatus has a cavity performance index of at least 1.27 dBA/W-cm3.

8. The life safety device as in claim 4 wherein the compact circumferential acoustic resonator contains a standing acoustic wave, between a node and an antinode, comprising an axial wave portion and a tangential wave portion when the audio output apparatus emits the tone.

9. The life safety device as in claim 8 wherein the tangential wave portion traverses at least 180 degrees within the ring shaped cavity.

10. The life safety device as in claim 4 wherein the compact circumferential acoustic resonator further comprises a circumferential channel section, a transducer coupling port, a center tapered duct, a radial port, and a seal plate.

11. The life safety device as in claim 4 wherein the outer thickness of the compact circumferential acoustic resonator is less than or equal to 0.5 inches.

12. The life safety device as in claim 4 wherein the audio output apparatus has a ratio of tangential wave portion path length to axial wave portion path length of at least 2.

13. The life safety device as in claim 4 wherein the sensor comprises one of a smoke sensor, a carbon monoxide sensor, a natural gas sensor, an intrusion sensor, a glass break sensor, a temperature sensor, or a vibration sensor.

14. A life safety device comprising:

electronic control circuitry;

a sensor connected to the electronic control circuitry;

an audio output apparatus comprising an audio output transducer acoustically coupled to a compact circumferential acoustic resonator;

the compact circumferential acoustic resonator amplifies the sound pressure level emitted from the audio output transducer when signaled by the electronic control circuitry when the sensor senses an environmental condition;

the compact circumferential acoustic resonator contains a standing acoustic wave, between a node and an antinode, when the audio transducer emits a tone on the order of 520 Hz;

the standing acoustic wave comprises a tangential wave portion within a ring-shaped cavity comprising a proximal end and a distal end, wherein the ring-shaped cavity is closed at the distal end; and the audio output apparatus is enclosed by a housing also enclosing the electronic control circuitry, and the sensor.

15. The life safety device as in claim 14 in which the audio output apparatus has a cavity performance index of at least 1.27 dBA/W-cm3.

16. The life safety device as in claim 14 wherein the audio output transducer comprises one of a piezo-electric transducer or a speaker.

17. The life safety device as in claim 14 wherein the audio output apparatus has a ratio of tangential wave portion path length to axial wave portion path length of at least 2.

18. The life safety device as in claim 14 wherein the compact circumferential acoustic resonator is a compliant cavity with a resonant frequency of on the order of 520 Hz.

19. The life safety device as in claim 14 wherein the sensor comprises at least one of a smoke sensor, a carbon monoxide sensor, a natural gas sensor, an intrusion sensor, a glass break sensor, a temperature sensor, or a vibration sensor.

20. A life safety device comprising:

a vented housing having a periphery with openings;

an environmental condition sensor;

electronic control circuitry;

an audio output apparatus comprising an audio output transducer and a compact circumferential acoustic resonator;

the compact circumferential acoustic resonator comprises a transducer coupling port, a ring-shaped cavity having a proximal end and a distal end, and a node forming wall at the distal end of the ring-shaped cavity;

the ring-shaped cavity guides an acoustic standing wave when the audio output transducer emits a tone;

the acoustic standing wave comprises a tangential wave portion the vented housing encloses the environmental condition sensor, the electronic control circuitry, and the audio output apparatus; and the audio output apparatus positioned relative to the environmental condition sensor such that ambient air and airborne substances, approaching the periphery of the vented housing from any direction, enter the environmental condition sensor unimpeded by the audio output apparatus.

21. The life safety device of claim 20 wherein the compact circumferential cavity further comprises a center tapered duct.

22. The life safety device as in claim 20 in which the outer thickness of the vented housing is less than 2.5 inches.

23. The life safety device as in claim 20 in which the outer thickness of the compact circumferential acoustic resonator is less than or equal to 0.5 inches.

24. The life safety device as in claim 20 in which the outer diameter of the compact circumferential acoustic resonator is less than or equal to 2.5 inches.

25. The life safety device as in claim 20 wherein the audio output transducer, having a movable surface, is coupled to the compact circumferential acoustic resonator thereby forming a closed volume between internal passages of the compact circumferential acoustic resonator and the movable surface.

26. The life safety device as in claim 25 wherein air inside the closed volume is a substantially fixed mass of air.

27. The life safety device as in claim 20 in which the audio output apparatus has a cavity performance index of at least 1.27 dBA/W-cm3.

28. The life safety device as in claim 20 wherein the environmental condition sensor comprises a smoke sensor, a carbon monoxide sensor, a natural gas sensor, an intrusion sensor, a glass break sensor, a temperature sensor, or a vibration sensor.

29. The life safety device as in claim 20 wherein the ring shaped cavity is helical.

* * * * *